United States Patent [19]

Robertson

[11] 3,988,795

[45] Nov. 2, 1976

[54] LIFE PRESERVER

[76] Inventor: James H. Robertson, P.O. Box 9551, North Hollywood, Calif. 91609

[22] Filed: Dec. 29, 1975

[21] Appl. No.: 644,575

[52] U.S. Cl. ..... 9/338; 9/311; 9/340; D34/43

[51] Int. Cl.[2] ..... B63C 9/10

[58] Field of Search ..... 9/311, 329, 336, 337, 9/338, 339, 340, 342, 345, 333; D34/43

[56] References Cited

UNITED STATES PATENTS

| | | | |
|---|---|---|---|
| 3,077,618 | 2/1963 | O'Link | 9/337 |
| 3,416,172 | 12/1968 | Gerling | 9/337 |

FOREIGN PATENTS OR APPLICATIONS

| | | | |
|---|---|---|---|
| 656,610 | 1/1963 | Canada | 9/338 |

*Primary Examiner*—Trygve M. Blix
*Assistant Examiner*—Charles E. Frankfort
*Attorney, Agent, or Firm*—Robert C. Comstock

[57] ABSTRACT

A conventional type of life preserver has a rectangular shape, with a circular neck receiving opening adjacent the upper end and a slit extending from the bottom of the opening to the lower edge of the preserver. The invention comprises a strap having one end thereof immovably molded into the preserver and extending from one side edge of the preserver to the slit. A pair of oppositely directed D-ring fastening members are mounted on the strap in recesses directed inwardly from opposite sides of the preserver adjacent to the slit. The portion of the strap past the D-rings slidably extends through a sleeve which is molded into the preserver from the slit to the opposite side edge. The strap has an elongated portion which extends around the body of the wearer, with a buckle on its end which may be selectively attached to either of the rings, depending on the direction in which the preserver is facing.

8 Claims, 2 Drawing Figures

LIFE PRESERVER

BACKGROUND OF THE INVENTION

1. Field of the Invention

The invention relates to a life preserver and more particularly to an improved strap assembly and structure for use in holding the preserver on the body of a user.

2. Description of the Prior Art

Adjustable life preservers of the split rectangular type to which this invention relates are well known in the art. Their strap structures and assemblies are, however, needlessly complex in both their structure and operation. This makes them more expensive to manufacture and more difficult to use, possibly even endangering the life of a confused person attempting to use them. There is also a possibility of such straps becoming entangled in use or prior to use.

SUMMARY OF THE INVENTION

The present invention provides a life preserver having a strap structure and assembly which is an improvement over prior devices and which overcomes substantially all of the problems and disadvantages present in the prior art.

In essence, the invention contemplates a strap structure which is far simpler in both its structure and operation because the straps are integrated into the structure of the preserver itself. One end of a strap is permanently laminated into one side of the preserver structure at the time it is molded. The other end of the strap slidably extends through a sleeve which is permanently laminated into the other side of the preserver at the time it is molded. The strap and its attachment members are always ready for use and are extremely simple to use. The strap can be used equally well with the life preserver facing in either direction.

It is accordingly among the objects of the invention to provide a life preserver having a strap structure and assembly which furnishes advantages and benefits not found in the prior art and which is simpler, stronger and better than those presently in use.

The invention also comprises such other objects, advantages and capabilities as will later more fully appear and which are inherently possessed by the invention.

While there is shown in the accompanying drawings a preferred embodiment of the invention, it should be understood that the same is susceptible of modification and change without departing from the spirit of the invention.

DESCRIPTION OF THE PREFERRED EMBODIMENT

Figure 1:
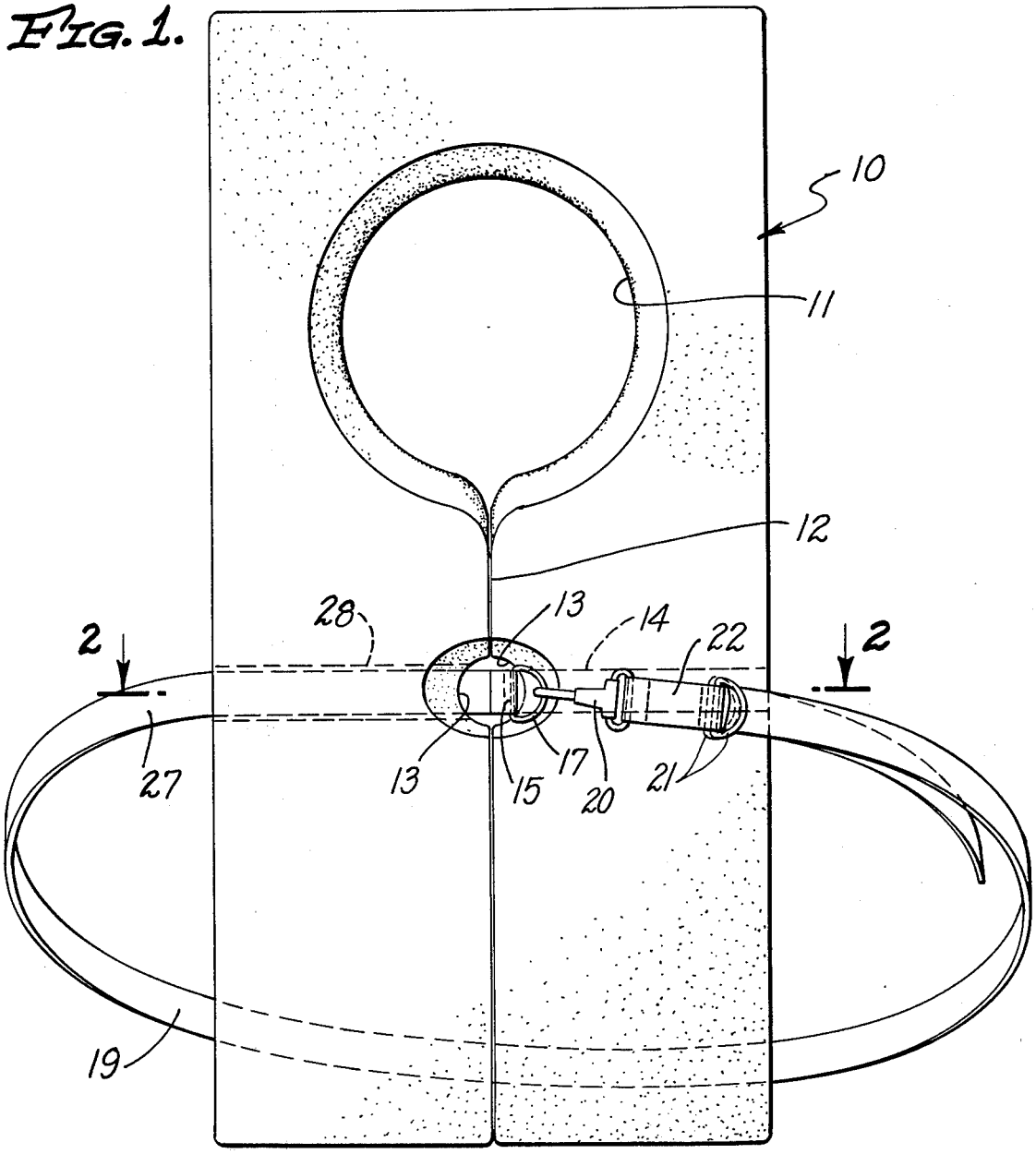
FIG. 1 is a front elevational view of a life preserver, with the buckle in closed position.
Figure 2:
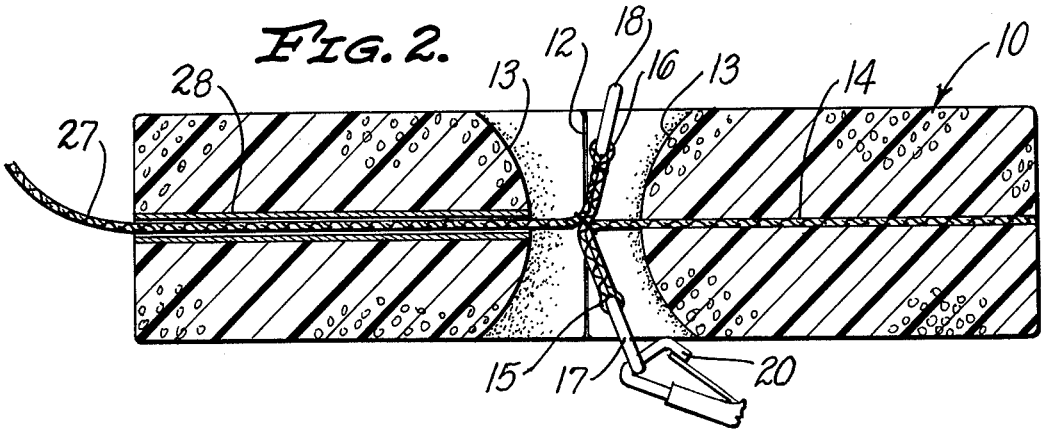
FIG. 2 is a sectional view of the same taken on line 2—2 of FIG. 1.

A preferred embodiment which has been selected to illustrate the invention is particularly adapted for use in connection with a well known type of preserver. The preserver 10 is formed of buoyant foam material and is substantially rectangular in shape. A circular opening 11 adjacent to the upper end of the preserver 10 is adapted to fit around the neck of the wearer. A split 12 extends continuously from the circular opening 11 to the lower edge of the preserver 10 to permit the preserver to be mounted over the head of the wearer.

The upper portion of the split 12 is intersected by a pair of recesses 13 which extend inwardly from opposite sides of the preserver 10.

An elongated strap which may suitably be formed of polypropylene webbing has an end portion 14 which extends transversely within the midportion of one side of the preserver 10 from one edge of the recesses 13 to the opposite side edge of the preserver 10. This strap portion 14 is preferably permanently bonded to the foam material forming the preserver 10 by the suitable bonding agents and/or by molding the preserver 10 around the strap portion 14 so that it becomes an integral part of the preserver 10.

The opposite end of the strap portion 14 extends into the recesses 13 and is bent back upon itself and secured by bar tacking to form a pair of loops 15 and 16, through which extend the straight portions of a pair of D-rings 17 and 18.

Integral with the webbing material forming the strap portion 14 and loops 15 and 16 is a further strap portion 27, which slidably extends through a hollow sleeve 28 which is bonded and laminated within the other side of the preserver 10, extending continuously from the split 12 to the opposite side edge of the preserver 10. The sleeve 28 may be formed of vinyl coated nylon or other suitable material and is open at both ends.

Beyond the outer end of the sleeve 28, the strap portion 27 has an integral elongated portion 19, which is adapted to extend around the body of the wearer. The free end of the elongated portion 19 extends through the circular portions of a pair of D-rings 21 for adjusting the length of the elongated portion 19. A short strap 22 which is connected at one end thereof to the straight portions of both D-rings 21 carries a buckle 20 at its opposite end. The buckle 20 is adapted to make snap engagement with either of the D-rings 17 or 18 within the recesses 13, depending on which way the preserver 10 is facing.

The free end of the elongated portion 19 may carry a transversely directed stop portion to prevent the elongated portion 19 from accidentally passing through and becoming separated from the D-rings 21.

It will be seen that the means used for securing the life preserver to the body of the wearer comprises but a single strap, one end of which is secured laminated within one side of the preserver and another part of which slidably extends through the other side of the preserver. The construction and operation of the strap assembly is much simpler and more efficient than heretofore and the life preserver can be used facing either direction without affecting the use and operation of the strap and buckling assembly.

I claim:

1. In a life preserver of the rectangular type having a circular neck receiving opening adjacent to the upper end thereof, with a straight slit extending from the bottom of the opening to the bottom of the preserver, the improvement comprising a strap having one end thereof immovably secured to the portion of said preserver on one side of said slit, at least one first fastening member mounted on said strap adjacent to said slit, the portion of said strap on the opposite side of said fastening member slidably extending through an opening in the portion of said preserver on the opposite side of said slit, said strap having an elongated portion extending substantially beyond said preserver, said elongated portion being adapted to extend around the body of a wearer, and a second fastening member carried by said elongated portion, said second fastening member being adapted to engage said first fastening member to secure said strap and hold said preserver on the body of a wearer.

2. The structure described in claim 1, said immovably secured end of said strap extending through the entire midportion of said life preserver between said slit and one side of said life preserver, said end of said strap being bonded to and integrated with said life preserver.

3. The structure described in claim 2, said opening in the opposite side of said life preserver being defined and enclosed by a sleeve, said sleeve extending continuously from said slit to the opposite side of said life preserver, said sleeve being bonded to and integrated with said life preserver.

4. The structure described in claim 3, said first fastening member comprising a pair of fastening members facing in opposite directions from each other, whereby said life preserver may be used facing in either direction by using the outwardly directed fastening member.

5. The structure described in claim 4, said pair of fastening members comprising a pair of D-rings mounted on a section of said strap having portions directed in opposite directions from each other and extending transversely with regard to said life preserver.

6. The structure described in claim 5, said rings and said section of said strap being disposed in recesses adjacent said slit on opposite sides thereof.

7. The structure described in claim 6, said second fastening member comprising a snap buckle adapted to engage either of said rings.

8. The structure described in claim 7, and means carried by said elongated portion of said strap for adjusting the length of said elongated portion.

* * * * *